US006882319B2

(12) United States Patent
Jinushi

(10) Patent No.: US 6,882,319 B2
(45) Date of Patent: Apr. 19, 2005

(54) ANTENNA MODULE WHOSE ANTENNA CHARACTERISTICS ARE NOT ADVERSELY AFFECTED BY A MOTHER BOARD

(75) Inventor: Satoru Jinushi, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/430,640

(22) Filed: May 6, 2003

(65) Prior Publication Data

US 2003/0210189 A1 Nov. 13, 2003

(30) Foreign Application Priority Data

May 13, 2002 (JP) ..... 2002-137441

(51) Int. Cl.[7] ..... H01Q 1/24; H01Q 9/26
(52) U.S. Cl. ..... 343/702; 343/806
(58) Field of Search ..... 343/702, 806, 343/700 MS, 895

(56) References Cited

U.S. PATENT DOCUMENTS 5,999,146 A 12/1999 Kanba et al.
6,337,667 B1 1/2002 Ayala et al.
6,459,413 B1 * 10/2002 Tseng et al. ..... 343/702

FOREIGN PATENT DOCUMENTS

| | | |
|---|---|---|
| EP | 0 944 128 | 9/1999 |
| EP | 1 154 513 | 11/2001 |
| JP | 2000-216612 | 8/2000 |
| WO | WO 01/13464 | 2/2001 |

* cited by examiner

*Primary Examiner*—Michael C. Wimer
(74) *Attorney, Agent, or Firm*—Brinks Hofer Gilson & Lione

(57) ABSTRACT

A chip-type antenna and a snaked, band-shaped conductor as a pair of radiation elements fed at the center, a circuit unit having a transmission/reception circuit that is connected to respective feeder lines for the radiation elements, and a connector that connects, to an external circuit, lead lines leading from the circuit unit are arranged on an insulative substrate to be mounted on a mother board. The pair of radiation elements extend along two adjoining sides of the insulative substrate so as to generally assume an L-shape in a plan view.

18 Claims, 1 Drawing Sheet

ANTENNA MODULE WHOSE ANTENNA CHARACTERISTICS ARE NOT ADVERSELY AFFECTED BY A MOTHER BOARD

BACKGROUND OF THE INVENTION

1. Field of the Invention

The present invention relates to an antenna module that is mounted on the mother board of an electronic apparatus such as a personal computer. In particular, the invention relates to an antenna module that is suitable for short-distance radio data communication.

2. Description of the Related Art

In recent years, radio data transfer methods that enable short-distance information exchange by transmitting and receiving radio waves in a prescribed frequency band (e.g., a 2.4-GHZ band) have come to attract much attention. With the spread of such a technology, in the future, it will become more necessary to provide an antenna module for transmission and reception of communication data on the mother board of an electronic apparatus such as a personal computer.

FIG. 2 illustrates a conventional antenna module of the above kind. As shown in FIG. 2, the antenna module is generally configured in such a manner that a chip-type antenna 2, a circuit unit 3, and a connector 4 are mounted on an insulative substrate 1 that is mounted on the mother board (not shown) of a personal computer or the like and that a ground conductor 5 is formed on the back surface of the insulative substrate 1. In the chip-type antenna 2, a band-shaped conductor 2*b* is formed spirally on the surface of a chip-shaped dielectric member 2*a*. The spiral, band-shaped conductor 2*b* is connected to a feeder line 6. One end, near the feeding point, of the spiral, band-shaped conductor 2*b* is connected to the ground conductor 5 through a through-hole (not shown). The overall length of the spiral, band-shaped conductor 2*b* is set slightly shorter than ¼ of the free space wavelength λ of radio waves used, that is, λ/4, with wavelength shortening by the dielectric member 2*a* taken into consideration. The circuit unit 3 is such that a transmission/reception circuit in which electronic parts such as amplifiers and an oscillator are arranged is covered with a shield case. The transmission/reception circuit is connected to the feeder line 6. The connector 4 is to connect, to a mother-board-side external circuit, lead lines leading from the transmission/reception circuit of the circuit unit 3.

The above conventional antenna module functions as what is called a monopole antenna in which one end of the spiral, band-shaped conductor 2*b* is grounded. That is, it utilizes a mirror principle: the spiral, band-shaped conductor 2*b* resonates as if an equivalent radiation element existed on the opposite side of the ground conductor 5. Therefore, unlike the case of a dipole antenna, it is not necessary to provide a pair of radiation elements. The antenna module is fabricated in this manner to decrease the occupation area of the radiation element on the insulative substrate 1 and hence the entire module can easily be miniaturized.

Compactness has become increasingly important for antenna modules to permit mounting of an antenna module on a mother board of an electronic apparatus such as a personal computer. The compactness of the above conventional antenna module is satisfactory. However, the very reason that the above conventional antenna module is compact enough to be useful, i.e. the antenna module is of a monopole type that utilizes a mirror principle in which the presence of the ground conductor 5 allows the spiral, band-shaped conductor 2*b* to resonate in the same manner as in a half-wave dipole, creates a problem. More specifically, because the resonance frequency of the antenna module shown in FIG. 2 depends on the positional relationship between the chip-type antenna 2 and the ground conductor 5, the antenna characteristics are affected by mother-board-side ground conductor. Moreover, as the ground conductor is relatively close to the antenna module, the antenna characteristics are highly sensitive to the position of the ground conductor with respect to the antenna module. This means that it is difficult to attain high reliability in both manufacturability, in addition to operability as it is not unlikely that the relative position may vary significantly, for example due to temperature fluctuations.

SUMMARY OF THE INVENTION

The present invention has been made in view of the above, and an object of the invention is therefore to provide a compact antenna module whose antenna characteristics are not affected by the position of a mother board/ground plane.

To attain the above object, an antenna module according to the invention comprises an insulative substrate to be mounted on a mother board; a pair of radiation elements that are mounted on the insulative substrate and fed at the center of the pair of radiation elements; a circuit unit that is mounted on the insulative substrate and has a reception circuit and/or a transmission circuit that are connected to feeder lines for the respective radiation elements; and a connector that is mounted on the insulative substrate and connects, to an external circuit, lead lines leading from the circuit unit, wherein at least one of the pair of radiation elements is a snaked, band-shaped conductor that is patterned in "meander" form on the insulative substrate.

In the above-configured antenna module, since the antenna structure is not of a monopole but of a half-wave dipole in which the pair of radiation elements are fed at the center, its antenna characteristics are not adversely affected by a mother-board-side ground conductor. Since the overall length of the snaked, band-shaped conductor extending in "meander" form may be set to about ¼ of the free space wavelength λ of radio waves used, the longitudinal dimension of a patterning region of the snaked, band-shaped conductor can be much smaller than λ/4. That is, one of the pair of radiation elements of the dipole antenna can be patterned in a relatively narrow region, whereby increase in the size of the insulative substrate can be avoided. Further, since the capacitance of the snaked, band-shaped conductor increases as its "meandering" pitch is decreased, impedance matching can be attained easily.

In the above configuration, the pair of radiation elements may be arranged so as to generally assume an L-shape in a plan view. In this case, since the radiation element scan bear ranged along two adjoining sides of the insulative substrate, the circuit unit and the connector can be arranged in the remaining region on the insulative substrate without being forced to be confined there, which means improvement in the space factor. This is favorable for miniaturization of the insulative substrate. The pair of radiation elements may be the snaked, band-shaped conductor and a chip-type antenna. In this case, the miniaturization of the insulative substrate is made easier than in the case where both of the radiation elements are a snaked, band-shaped conductor.

DESCRIPTION OF THE PREFERRED EMBODIMENT

An embodiment of the present invention will be hereinafter described with reference to FIG. 1, which illustrates an antenna module according to the embodiment of the invention. Components in FIG. 1 having corresponding components in FIG. 2 are given the same reference symbols as the latter.

Figure 1:
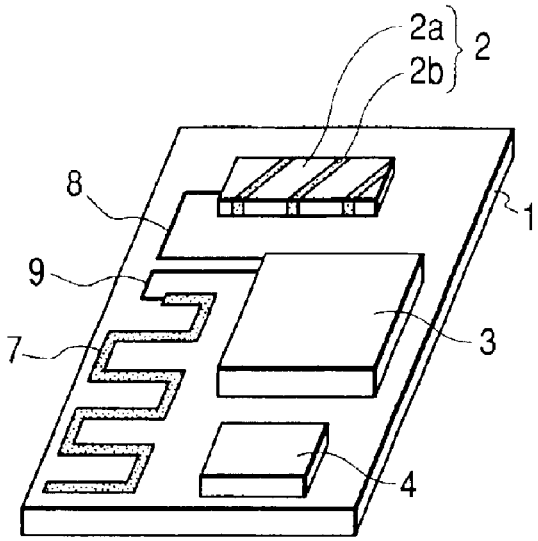
FIG. 1 illustrates an antenna module according to an embodiment of the present invention.
Figure 2:
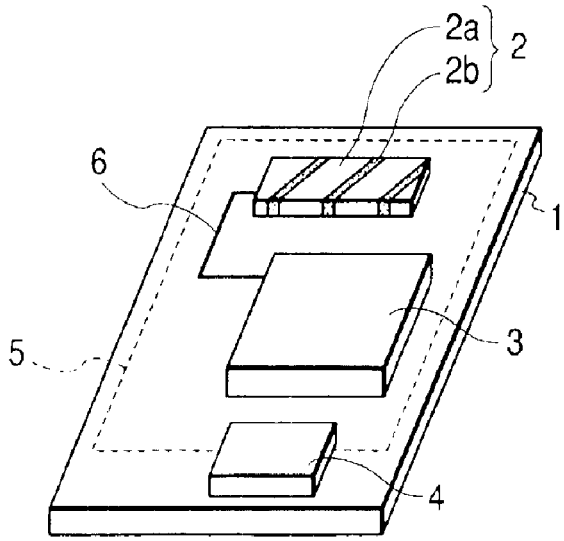
FIG. 2 PRIOR ART
FIG. 2 illustrates a conventional antenna module.

The antenna module shown in FIG. 1 is generally configured in such a manner that a chip-type antenna 2 and a snaked, band-shaped conductor 7 as a pair of radiation elements that are fed at the center, a circuit unit 3 in which a transmission/reception circuit connected to feeder lines 8 and 9 for the respective radiation elements 2 and 7 is covered with a shield case, and a connector 4 that connects, to a mother-board-side external circuit, lead lines leading from the transmission/reception circuit are arranged on an insulative substrate 1 that is mounted on the mother board (not shown) of a personal computer or the like.

The chip-type antenna 2 is of a known type in which a band-shaped conductor 2*b* is formed spirally on the surface of a chip-shaped dielectric member 2*a*. The feeder line 8 is connected to one end of the spiral, band-shaped conductor 2*b*. The overall length of the spiral, band-shaped conductor 2*b* is set slightly shorter than ¼ of the free space wavelength λ of radio waves used, that is, λ/4, with wavelength shortening by the dielectric member 2*a* taken in to consideration. The snaked, band-shaped conductor 7 is a band-shaped conductor that is patterned on the insulative substrate 1 so as to snake in "meander" form, and its overall length is set to about λ/4. The chip-type antenna 2 and the snaked, band-shaped conductor 7 (meander conductor) extend along two adjoining sides of one face of the insulative substrate 1 so as to generally assume an L-shape in a plan view. The two terminals of a radio-frequency power source are connected to the respective feeder lines 8 and 9.

The antenna structure of the above-described antenna module is of a half-wave dipole in which the pair of radiation elements 2 and 7 are fed at the center of the pair. This substantially eliminates the effect of the mother-board-side ground conductor on the antenna characteristics of the antenna module and permits a high reliability antenna module to be produced. The snaked, band-shaped conductor 7 (one radiation element) occupies a slightly wider area on the insulative substrate 1 than the chip-shaped antenna 2 (the other radiation element) does. However, the longitudinal dimension of the patterning region of the snaked, band-shaped conductor 7 in "meander" form is still much smaller than λ/4. Further, in this embodiment, since the pair of radiation elements 2 and 7 extend along the two adjoining sides of one face of the insulative substrate 1 so as to generally assume an L-shape in a plan view, the circuit unit 3 and the connector 4 can be arranged in the remaining region on the same side of the insulative substrate 1 without increasing the overall area of the insulative substrate 1 necessary to contain all of this circuitry present on the face. That is, in this antenna module although the pair of radiation elements 2 and 7 of the dipole antenna are provided to increase the reliability, it is not necessary to increase the size of the insulative substrate 1, thereby permitting a compact antenna module to be more easily mounted on the mother board of a personal computer or the like.

Impedance matching, which is indispensable in manufacturing the above-type of antenna module, can be conducted relatively easily by selecting a pattern shape of the snaked, band-shaped conductor 7 as appropriate. That is, since the capacitance of the snaked, band-shaped conductor 7 increases as the pitch of its "meandering" is decreased, impedance matching can easily be attained by varying the capacitive reactance component as appropriate.

In another possible embodiment, a snaked, band-shaped conductor that is similar to the snaked, band-shaped conductor 7 may be provided in place of the chip-type antenna 2, that is, two snaked, band-shaped conductors in "meander" form are used as the pair of radiation elements of the dipole antenna. However, this will increase the overall size of the antenna module, even if the conductors are formed in an L shape in plan view, and thus, from the viewpoint of miniaturizing the insulative substrate 1, it is preferable to employ a chip-type antenna as one radiation element. To further decrease the overall size of the insulation substrate required, in an additional embodiment, two chip-type antennas may be used as the pair of radiation elements of the dipole antenna. However, this embodiment is not preferable because while the insulative substrate is further miniaturized from that shown in FIG. 1, such an embodiment complicates the impedance matching and increases both the manufacturing costs as well as increases the parts cost as the cost of the second chip-type antenna exceeds that of the meander conductor.

Practiced in the above-described manner, the invention provides the following advantages.

Since the antenna structure is not of a monopole but of a half-wave dipole in which a pair of radiation elements is fed at the center of the pair, there the antenna characteristics are not adversely affected by a mother-board-side ground conductor. Since the snaked, band-shaped conductor in "meander" form can be patterned in a relatively narrow region, increase in the size of the insulative substrate can be avoided by arranging the pair of radiation elements so that they generally assume an L-shape, for example, in a plan view. Further, the capacitance of the snaked, band-shaped conductor varies in accordance with its "meandering" pitch, impedance matching can be attained easily. Therefore, a highly practical antenna module can be provided that is highly reliable in that its antenna characteristics are not adversely affected by a mother board while being compact enough to permit it to be mounted on the mother board of an electronic apparatus such as a personal computer.

What is claimed is:

1. An antenna module comprising:

an insulative substrate to be mounted on a mother board;

a pair of radiation elements that are mounted on the insulative substrate and fed at a center of the pair of radiation elements;

a circuit unit that is mounted on the insulative substrate and has at least one of a reception circuit and a transmission circuit connected to feeder lines for the respective radiation elements; and a connector that is mounted on the insulative substrate and connects, to an external circuit, lead lines leading from the circuit unit, wherein at least one of the pair of radiation elements is a snaked, band-shaped conductor that is patterned in meander form on the insulative substrate.

2. The antenna module according to claim 1, wherein the pair of radiation elements are arranged so as to generally assume an L-shape in a plan view.

3. The antenna module according to claim 1, wherein one of the pair of radiation elements is the snaked, band-shaped conductor and the other is a chip-type antenna.

4. The antenna module according to claim 1, wherein the conductor radiation element and the other of the pair of radiation elements are disposed on opposite sides of the same surface of the insulative substrate.

5. The antenna module according to claim 1, wherein the antenna module is a half-wave dipole.

6. An electronic apparatus comprising an antenna module and a mother board, the antenna module including:

an insulative substrate mounted on the mother board;

a plurality of radiation elements mounted on the insulative substrate, at least one of the radiation elements being a meander conductor patterned on the insulative substrate;

a circuit unit mounted on the insulative substrate, the circuit unit having at least one of a reception circuit and a transmission circuit;

feeder lines configured to transmit signals between the circuit unit and the radiation elements, the feeder lines connected to at least a pair of the radiation elements one of which is the meander conductor at a center of the pair of the radiation elements; and a connector mounted on the insulative substrate that connects lead lines leading from the circuit unit to circuitry external to the antenna module.

7. The electronic apparatus according to claim 6, wherein the pair of radiation elements are arranged so as to generally assume an L-shape in a plan view.

8. The electronic apparatus according to claim 6, wherein one of the pair of radiation elements is the meander conductor and the other is a conductor formed spirally on a surface of a chip-shaped dielectric member.

9. The electronic apparatus according to claim 6, wherein the pair of radiation elements are disposed on opposite sides of the same surface of the insulative substrate.

10. The electronic apparatus according to claim 6, wherein the antenna module is a half-wave dipole.

11. A method of decreasing sensitivity of antenna characteristics of an antenna module to a position of a mother board on which the antenna module is mounted, the method comprising:

patterning a meander conductor as a first radiation element on a surface of an insulative substrate;

introducing at least a second radiation element to the surface of an insulative substrate;

mounting a circuit unit of at least one of a reception circuit and a transmission circuit on the surface of the insulative substrate;

connecting feeder lines between the circuit unit and the first and second radiation elements and connecting the feeder lines to the first and second radiation elements at a center of the first and second radiation elements;

providing a connector on the surface of the insulative substrate and connecting lead lines leading from the circuit unit to circuitry external to the antenna module; and mounting the insulative substrate on the mother board.

12. The method according to claim 11, further comprising decreasing a space factor and increasing miniaturization of the antenna module by arranging the first and second radiation elements in generally an L-shape in a plan view.

13. The method according to claim 11, further comprising mounting a conductor formed spirally on a surface of a chip-shaped dielectric member on the surface of the insulative substrate as the second radiation element.

14. The method according to claim 11, further comprising impedance matching by adjusting a pitch of meander of the conductor to alter capacitance of the conductor while maintaining a length of the conductor.

15. The method according to claim 11, further comprising arranging the first and second radiation elements on opposite sides of the surface of the insulative substrate.

16. The method according to claim 11, further comprising limiting the antenna module to a half-wave dipole-type antenna module.

17. An antenna module comprising:

an insulative substrate to be mounted on a mother board;

a first and a second radiation element having adjacent ends, the radiation elements mounted on the insulative substrate;

a circuit unit that is mounted on the insulative substrate and having at least one of a reception circuit and a transmission circuit;

a first and a second feeder line, the feeder lines connecting the circuit unit and the adjacent ends of the radiation elements; and a connector mounted on the insulative substrate and which connects to an external circuit, wherein at least one of the radiation elements is a snaked, band-shaped conductor that is patterned in meander form on the insulative substrate.

18. The antenna module according to claim 17, wherein the radiation elements comprise a half-wave dipole.

* * * * *